US006640908B2

(12) United States Patent
Jones et al.

(10) Patent No.: US 6,640,908 B2
(45) Date of Patent: Nov. 4, 2003

(54) APPARATUS AND METHOD FOR FORMATION TESTING WHILE DRILLING WITH MINIMUM SYSTEM VOLUME

(75) Inventors: Stanley C. Jones, Littleton, CO (US); John M. Michaels, Houston, TX (US); Jaedong Lee, Houston, TX (US); Matthias Meister, Celle (DE); Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/213,865

(22) Filed: Aug. 7, 2002

(65) Prior Publication Data

US 2002/0185313 A1 Dec. 12, 2002

Related U.S. Application Data

(63) Continuation of application No. 09/621,398, filed on Jul. 21, 2000, now Pat. No. 6,478,096.

(51) Int. Cl.[7] ..... E21B 49/10

(52) U.S. Cl. ..... 175/50; 166/250.01; 73/152.18

(58) Field of Search ..... 175/40, 48, 50, 175/308; 166/336, 250.1, 252.5, 254.1, 254.2, 250.02, 250.09, 264, 373; 73/152.18, 152.19, 152.22, 152.23

(56) References Cited

U.S. PATENT DOCUMENTS

| | | | | | |
|---|---|---|---|---|---|
| 3,864,970 | A | | 2/1975 | Bell | 73/155 |
| 4,833,914 | A | * | 5/1989 | Rasmus | 73/152 |
| 5,428,293 | A | * | 6/1995 | Sinclair et al. | 324/339 |
| 5,799,733 | A | * | 9/1998 | Ringgenberg et al. | 166/264 |
| 5,803,186 | A | * | 9/1998 | Berger et al. | 175/50 |
| 6,157,893 | A | * | 12/2000 | Berger et al. | 702/9 |
| 6,178,815 | B1 | * | 1/2001 | Felling et al. | 73/152.19 |
| 6,206,108 | B1 | * | 3/2001 | MacDonald et al. | 175/24 |

FOREIGN PATENT DOCUMENTS

GB 2334982 * 9/1999

* cited by examiner

*Primary Examiner*—Frank Tsay
(74) *Attorney, Agent, or Firm*—Madan, Mossman & Sriram, P.C.

(57) ABSTRACT

A minimum volume apparatus and method is provided including a tool for obtaining at least one parameter of interest of a subterranean formation in-situ, the tool comprising a carrier member, a selectively extendable member mounted on the carrier for isolating a portion of annulus, a port exposable to formation fluid in the isolated annulus space, a piston integrally disposed within the extendable member for urging the fluid into the port, and a sensor operatively associated with the port for detecting at least one parameter of interest of the fluid.

23 Claims, 8 Drawing Sheets

APPARATUS AND METHOD FOR FORMATION TESTING WHILE DRILLING WITH MINIMUM SYSTEM VOLUME

CROSS REFERENCES TO RELATED APPLICATIONS

This application is a continuation of Nonprovisional U.S. patent application Ser. No. 09/621,398 filed on Jul. 21, 2000 now U.S. Pat. No. 6,478,096.

BACKGROUND OF THE INVENTION

1. Field of the Invention

This invention generally relates to the testing of underground formations or reservoirs. More particularly, this invention relates to a reduced volume method and apparatus for sampling and testing a formation fluid.

2. Description of the Related Art

To obtain hydrocarbons such as oil and gas, well boreholes are drilled by rotating a drill bit attached at a drill string end. The drill string may be a jointed rotatable pipe or a coiled tube. A large portion of the current drilling activity involves directional drilling, i.e., drilling boreholes deviated from vertical and/or horizontal boreholes, to increase the hydrocarbon production and/or to withdraw additional hydrocarbons from earth formations. Modem directional drilling systems generally employ a drill string having a bottomhole assembly (BHA) and a drill bit at an end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional downhole instruments, known as measurement-while-drilling (MWD) or logging-while-drilling (LWD) tools, are frequently attached to the drill string to determine formation geology and formation fluid conditions during the drilling operations.

Pressurized drilling fluid (commonly known as the "mud" or "drilling mud") is pumped into the drill pipe to rotate the drill motor, to provide lubrication to various members of the drill string including the drill bit and to remove cuttings produced by the drill bit. The drill pipe is rotated by a prime mover, such as a motor, to facilitate directional drilling and to drill vertical boreholes. The drill bit is typically coupled to a bearing assembly having a drive shaft which in turn rotates the drill bit attached thereto. Radial and axial bearings in the bearing assembly provide support to the drill bit against these radial and axial forces.

Boreholes are usually drilled along predetermined paths and proceed through various formations. A drilling operator typically controls the surface-controlled drilling parameters to optimize the drilling operations. These parameters include weight on bit, drilling fluid flow through the drill pipe, drill string rotational speed (r.p.m. of the surface motor coupled to the drill pipe) and the density and viscosity of the drilling fluid. The downhole operating conditions continually change and the operator must react to such changes and adjust the surface-controlled parameters to continually optimize the drilling operations. For drilling a borehole in a virgin region, the operator typically relies on seismic survey plots, which provide a macro picture of the subsurface formations and a pre-planned borehole path. For drilling multiple boreholes in the same formation, the operator may also have information about the previously drilled boreholes in the same formation.

Typically, the information provided to the operator during drilling includes borehole pressure, temperature, and drilling parameters such as weight-on-bit (WOB), rotational speed of the drill bit and/or the drill string, and the drilling fluid flow rate. In some cases, the drilling operator is also provided selected information about the bottomhole assembly condition (parameters), such as torque, mud motor differential pressure, torque, bit bounce and whirl, etc.

Downhole sensor data are typically processed downhole to some extent and telemetered uphole by sending a signal through the drill string or by transmitting pressure pulses through the circulating drilling fluid, i.e. mud-pulse telemetry. Although mud-pulse telemetry is more commonly used, such a system is capable of transmitting only a few (1–4) bits of information per second. Due to such a low transmission rate, the trend in the industry has been to attempt to process greater amounts of data downhole and transmit selected computed results or "answers" uphole for use by the driller for controlling the drilling operations.

Commercial development of hydrocarbon fields requires significant amounts of capital. Before field development begins, operators desire to have as much data as possible in order to evaluate the reservoir for commercial viability. Despite the advances in data acquisition during drilling using the MWD systems, it is often necessary to conduct further testing of the hydrocarbon reservoirs in order to obtain additional data. Therefore, after the well has been drilled, the hydrocarbon zones are often tested with other test equipment.

One type of post-drilling test involves producing fluid from the reservoir, collecting samples, shutting-in the well, reducing a test volume pressure, and allowing the pressure to build-up to a static level. This sequence may be repeated several times at several different reservoirs within a given borehole or at several points in a single reservoir. This type of test is known as a "Pressure Build-up Test." One important aspect of data collected during such a Pressure Build-up Test is the pressure buildup information gathered after drawing down the pressure in the test volume. From this data, information can be derived as to permeability and size of the reservoir. Moreover, actual samples of the reservoir fluid can be obtained and tested to gather Pressure-Volume-Temperature data relevant to the reservoir's hydrocarbon distribution.

Some systems require retrieval of the drill string from the borehole to perform pressure testing. The drill is removed, and a pressure measuring tool is run into the borehole using a wireline and packers for isolating the reservoir. Although wireline conveyed tools are capable of testing a reservoir, it is difficult to convey a wireline tool in a deviated borehole.

Numerous communication devices have been designed which provide for manipulation of the test assembly, or alternatively, provide for data transmission from the test assembly. Some of those designs include mud-pulse telemetry to or from a downhole microprocessor located within, or associated with the test assembly. Alternatively, a wire line can be lowered from the surface, into a landing receptacle located within a test assembly, thereby establishing electrical signal communication between the surface and the test assembly.

Regardless of the type of test equipment currently used, and regardless of the type of communication system used, the amount of time and money required for retrieving the drill string and running a second test rig into the hole is significant. Further, when a hole is highly deviated wireline conveyed test figures cannot be used because frictional force between the test rig and the wellbore exceed gravitational force causing the test rig to stop before reaching the desired formation.

A more recent system is disclosed in U.S. Pat. No. 5,803,186 to Berger et al. The '186 patent provides a MWD system that includes use of pressure and resistivity sensors with the MWD system, to allow for real time data transmission of those measurements. The '186 device enables obtaining static pressures, pressure build-ups, and pressure draw-downs with the work string, such as a drill string, in place. Also, computation of permeability and other reservoir parameters based on the pressure measurements can be accomplished without removing the drill string from the borehole.

A problem with the system described in the '186 patent relates to the time required for completing a test. During drilling, density of the drilling fluid is calculated to achieve maximum drilling efficiency while maintaining safety, and the density calculation is based upon the desired relationship between the weight of the drilling mud column and the predicted downhole pressures to be encountered. After a test is taken a new prediction is made, the mud density is adjusted as required and the bit advances until another test is taken. Different formations are penetrated during drilling, and the pressure can change significantly from one formation to the next and in short distances due to different formation compositions. If formation pressure is lower than expected, the pressure from the mud column may cause unnecessary damage to the formation. If the formation pressure is higher than expected, a pressure kick could result. Consequently, delay in providing measured pressure information to the operator results in drilling mud being maintained at too high or too low a density for maximum efficiency and maximum safety.

A drawback of the '186 patent, as well as other systems requiring fluid intake, is-that system clogging caused by debris in the fluid can seriously impede drilling operations. When drawing fluid into the system, cuttings from the drill bit or other rocks being carried by the fluid may enter the system. The '186 patent discloses a series of conduit paths and valves through which the fluid must travel. It is possible for debris to clog the system at any valve location, at a conduit bend or at any location where conduit size changes. If the system is clogged, it may have to be retrieved from the borehole for cleaning causing enormous delay in the drilling operation. Therefore, it is desirable to have an apparatus with reduced risk of clogging to increase drilling efficiency.

Another drawback of the '186 patent is that it has a large system volume. Filling a system with fluid takes time, so a system with a large internal volume requires more time to sample and test than does a system with a smaller internal volume. Therefore it is desirable to minimize internal system volume in order to maximize sampling and test efficiency.

SUMMARY OF THE INVENTION

The present invention addresses some of the drawbacks discussed above by providing a measurement while drilling apparatus and method which enables sampling and measurements of parameters of fluids contained in a borehole while reducing the time required for taking such samples and measurements and reducing the risk of system clogging.

A minimum system volume apparatus is provided comprising a tool for obtaining at least one parameter of interest for a subterranean formation in-situ. The tool comprises a carrier member for conveying the tool into a borehole; at least one extendable member mounted on the carrier member, the at least one extendable member being selectively extendable into sealing engagement with the wall of the borehole for isolating a portion of an annular space between the carrier member and the formations; a port exposable to a fluid containing formation fluid in the isolated annular space; a piston integrally disposed within the extendable member for urging the fluid contained in the isolated annular space into the port; and a sensor operatively associated with the port for detecting at least one parameter of interest of the fluid indicative of the at least one formation parameter of interest.

In addition to the apparatus provided, a method is provided for obtaining at least one parameter of interest for a subterranean formation in-situ. The method comprises conveying a tool on a carrier member into a borehole; extending at least one pad member mounted on the carrier member; isolating a portion of an annular space between the carrier member and the borehole with the at least one pad member; exposing a port to a fluid containing formation fluid in the isolated annular space; urging the fluid contained in the isolated annular space into the port with a piston integrally disposed within the pad member; and detecting at least one parameter of interest of the fluid with a sensor operatively associated with the port for detecting, the at least one fluid parameter of interest indicative of the at least one formation parameter of interest.

The novel features of this invention, as well as the invention itself, will be best understood from the attached drawings, taken along with the following description, in which similar reference characters refer to similar parts.

DESCRIPTION OF PREFERRED EMBODIMENTS

Figure 1:
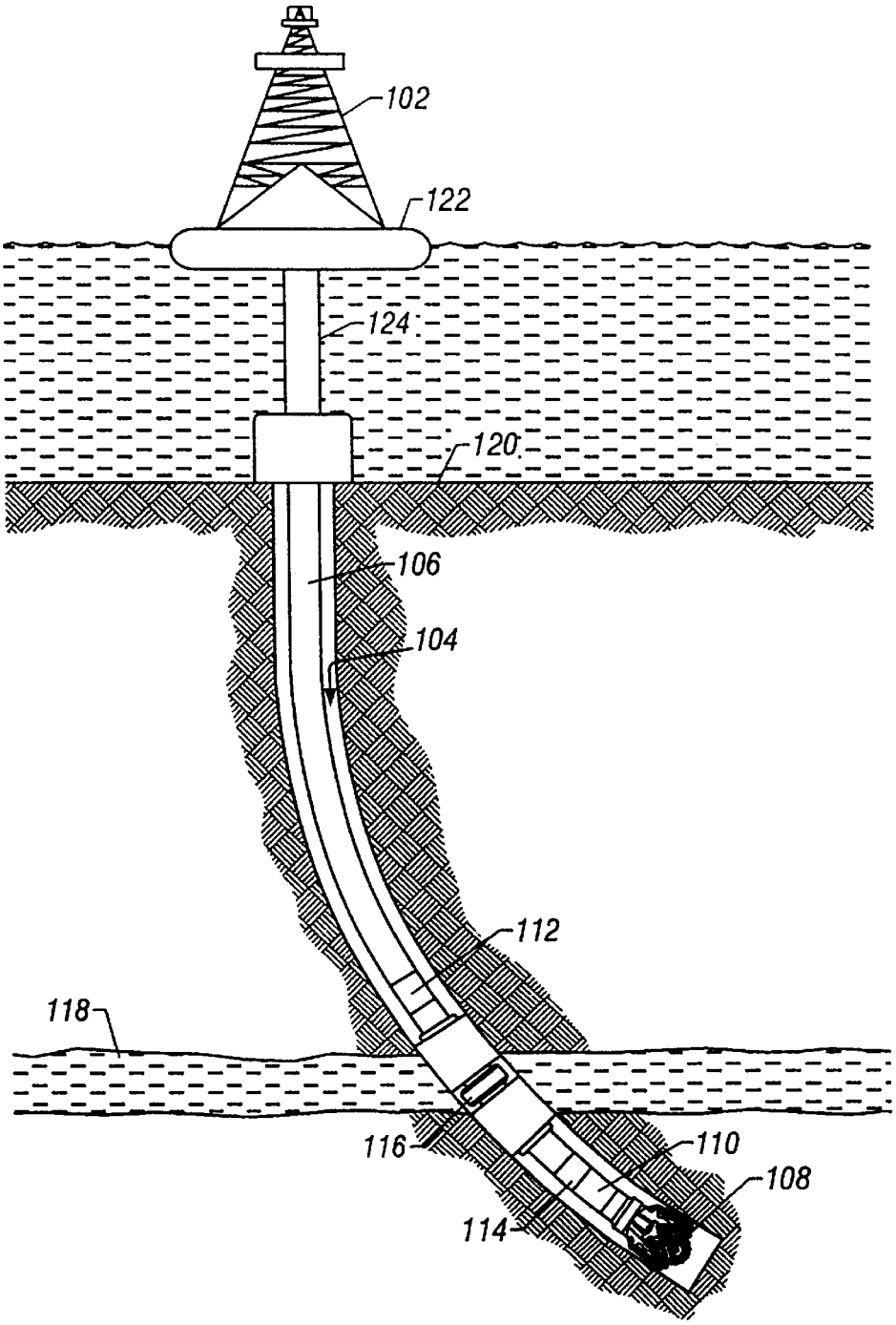
FIG. 1 is an elevation view of an offshore drilling system according to one embodiment of the present invention.

FIG. 1 is a typical drilling rig 102 with a borehole 104 being drilled into the subterranean formations 118, as is well understood by those of ordinary skill in the art. The drilling rig 102 has a work string 106, which in the typical embodiment shown in FIG. 1 is a drill string. The work string 106 has attached thereto a drill bit 108 for drilling the borehole 104. The present invention is also useful in other types of work strings, and it is useful with jointed tubing as well as coiled tubing or other small diameter work string such as snubbing pipe. The drilling rig 102 is shown positioned on a drilling ship 122 with a riser 124 extending from the drilling ship 122 to the sea floor 120.

If applicable, the drill string 106 (or any suitable work string) can have a downhole drill motor 110 for rotating the drill bit 108. Incorporated in the drill string 106 above the drill bit 108 is at least one typical sensor 114 to sense downhole characteristics of the borehole, the bit, and the reservoir. Typical sensors sense characteristics such as temperature, pressure, bit speed, depth, gravitational pull, orientation, azimuth, fluid density, dielectric, etc. The drill string 106 also contains the formation test apparatus 116 of the present invention, which will be described in greater detail hereinafter. A telemetry system 112 is located in a suitable location on the drill string 106 such as uphole from the test apparatus 116. The telemetry system 112 is used to receive commands from, and send data to, the surface.

Figure 2:
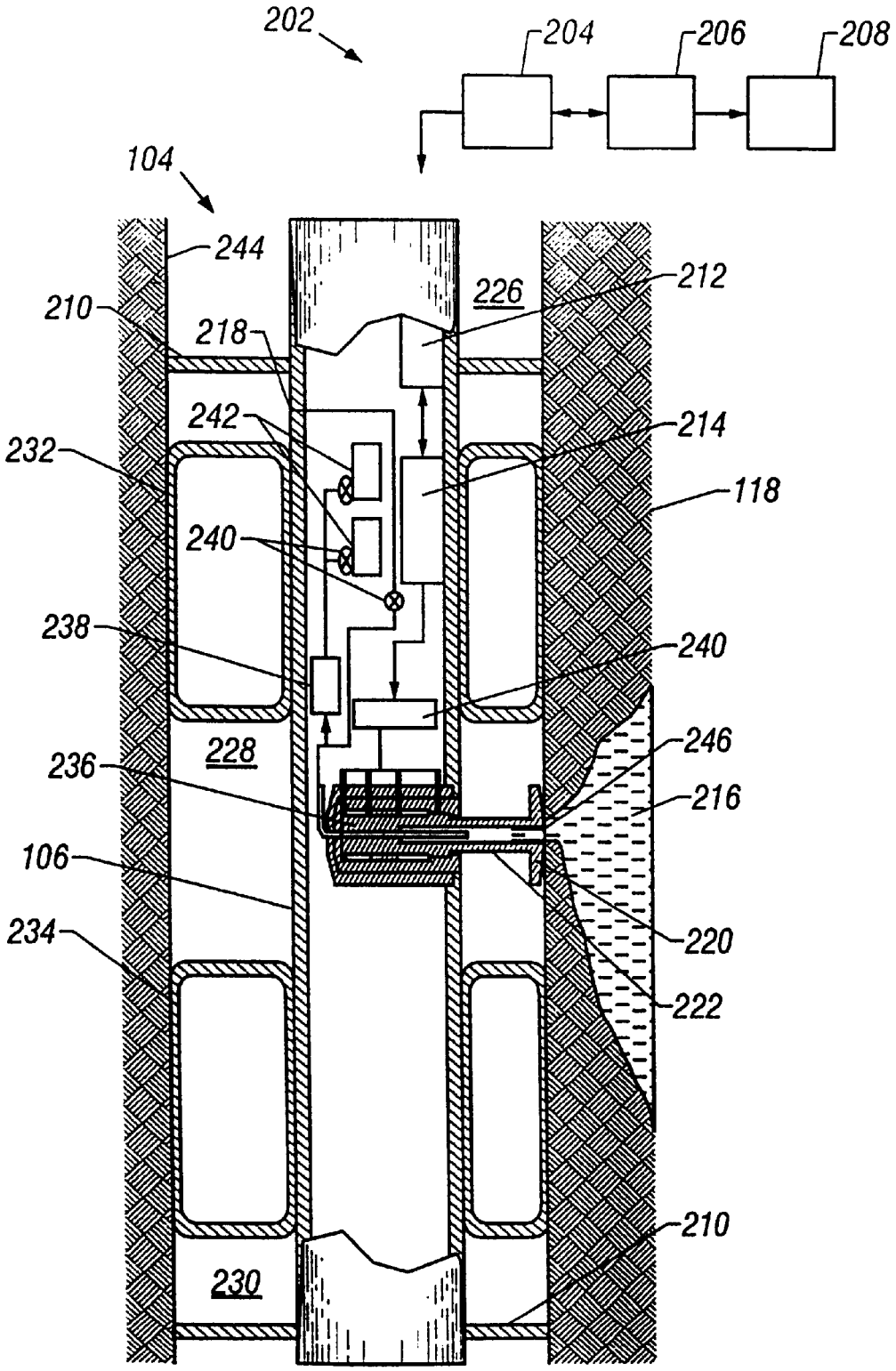
FIG. 2 shows a preferred embodiment of the present invention wherein downhole components are housed in a portion of drill string and a surface controller is shown schematically.

FIG. 2 is a cross section elevation view of a preferred system according to the present invention. The system includes surface components and downhole components to carry out "Formation Testing While Drilling" (FTWD) operations. A borehole 104 is shown drilled into a formation 118 containing a formation fluid 216. Disposed in the borehole 104 is a drill string 106. The downhole components are conveyed on the drill string 106, and the surface components are located in suitable locations on the surface. A surface controller 202 typically includes a communication system 204 electronically connected to a processor 206 and an input/output device 208, all of which are well known in the art. The input/out device 208 may be a typical terminal for user inputs. A display such as a monitor or graphical user interface may be included for real time user interface. When hard-copy reports are desired, a printer may be used. Storage media such as CD, tape or disk are used to store data retrieved from downhole for future analyses. The processor 206 is used for processing (encoding) commands to be transmitted downhole and for processing (decoding) data received from downhole via the communication system 204. The surface communication system 204 includes a receiver for receiving data transmitted from downhole and transferring the data to the surface processor for evaluation recording and display. A transmitter is also included with the communication system 204 to send commands to the downhole components. Telemetry is typically relatively slow mud-pulse telemetry, so downhole processors are often deployed for preprocessing data prior to transmitting results of the processed data to the surface.

A known communication and power unit 212 is disposed in the drill string 106 and includes a transmitter and receiver for two-way communication with the surface controller 202. The power unit, typically a mud turbine generator, provides electrical power to run the downhole components.

Connected to the communication and power unit 212 is a controller 214. As stated earlier a downhole processor (not separately shown) is preferred when using mud-pulse telemetry; the processor being integral to the controller 214. The controller 214 uses preprogrammed commands, surface-initiated commands or a combination of the two to control the downhole components. The controller controls the extension of anchoring, stabilizing and sealing elements disposed on the drill string, such as grippers 210 and packers 232 and 234. The control of various valves (not shown) can control the inflation and deflation of packers 232 and 234 by directing drilling mud flowing through the drill string 106 to the packers 232 and 234. This is an efficient and well-known method to seal a portion of the annulus or to provide drill string stabilization while sampling and tests are conducted. When deployed, the packers 232 and 234 separate the annulus into an upper annulus 226, an intermediate annulus 228 and a lower annulus 230. The creation of the intermediate annulus 228 sealed from the upper annulus 226 and lower annulus 230 provides a smaller annular volume for enhanced control of the fluid contained in the volume.

The grippers 210, preferably have a roughened end surface for engaging the well wall 244 to anchor the drill string 106. Anchoring the drill string 106 protects soft components such as the packers 232 and 234 and pad member 220 from damage due to tool movement. The grippers 210 would be especially desirable in offshore systems such as the one shown in FIG. 1, because movement caused by heave can cause premature wear out of sealing components.

The controller 214 is also used to control a plurality of valves 240 combined in a multi-position valve assembly or series of independent valves. The valves 240 direct fluid flow driven by a pump 238 disposed in the drill string 106 to extend a pad piston 222, operate a drawdown piston or otherwise called a draw piston 236, and control pressure in the intermediate annulus 228 by pumping fluid from the annulus 228 through a vent 218. The annular fluid may be stored in an optional storage tank 242 or vented to the upper 226 or lower annulus 230 through standard piping and the vent 218.

Mounted on the drill string 106 via a pad piston 222 is a pad member 220 for engaging the borehole wall 244. The pad member 220 is a soft elastomer cushion such as rubber. The pad piston 222 is used to extend the pad 220 to the borehole wall 244. A pad 220 seals a portion of the annulus 228 from the rest of the annulus. A port 246 located on the pad 220 is exposed to formation fluid 216, which tends to enter the sealed annulus when the pressure at the port 246 drops below the pressure of the surrounding formation 118. The port pressure is reduced and the formation fluid 216 is drawn into the port 246 by a draw piston 236. The draw piston 236 is operated hydraulically and is integral to the pad piston 222 for the smallest possible fluid volume within the tool. The small volume allows for faster measurements and reduces the probability of system contamination from the debris being drawn into the system with the fluid.

It is possible to cause damage downhole seals and the borehole mudcake when extending the pad member 220, expanding the packers 232 and 234, or when venting fluid. Care should be exercised to ensure the pressure is vented or exhausted to an area outside the intermediate annulus 228. FIG. 2 shows a preferred location for the vent 218 above the upper packer 232. It is also possible to prevent damage by leaving the upper packer 232 in a retracted position until the lower packer 234 is set and the pad member 220 is sealed against the borehole wall.

Figure 3:
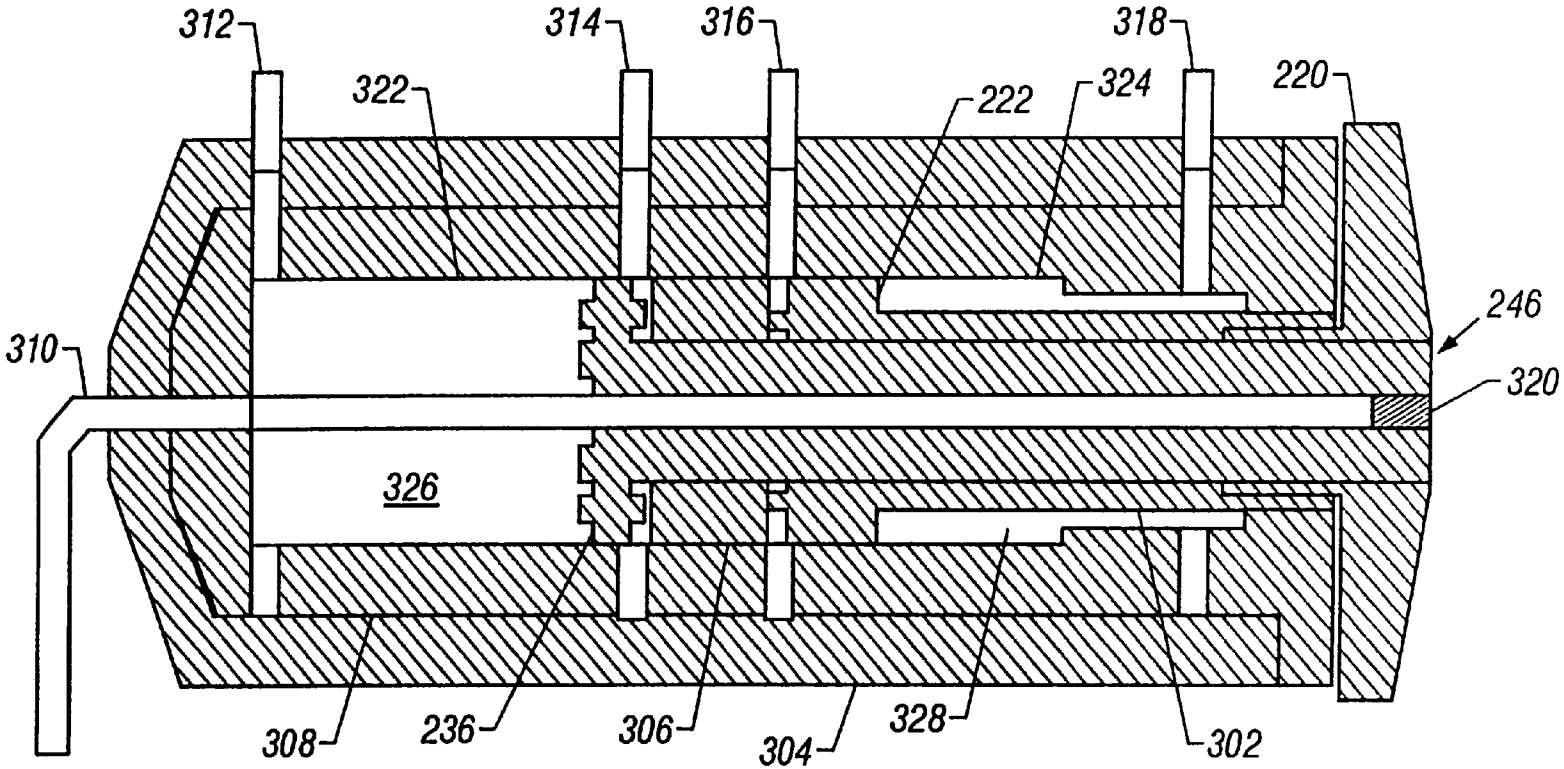
FIG. 3 is a detailed cross sectional view of an integrated pump and pad in an inactive state according to the present invention.

FIGS. 3 through 6 show details of the pad 220 and pistons 222 and 236 in more detail and in several operational positions. FIG. 3 is a cross sectional view of the fluid sampling unit of FIG. 2 in its initial, inactive or transport position. In the position shown in FIG. 3, the pad member 220 is fully retracted toward a tool housing 304. A sensor 320 is disposed at the end of the pad member 226. Disposed within the tool housing 304 is a piston cylinder 308 that contains hydraulic oil or drilling mud 326 in a draw reservoir 322 for operating the draw piston 236. The draw piston 236 is coaxially disposed within the drawdown cylinder 308 and is shown in its outermost or initial position. In this initial position, there is substantially zero volume at the port 246. The pad extension piston 222 is shown disposed circumferentially around and coaxially with the draw piston 236. A barrier 306 disposed between the base of the draw piston 236 and the base of the pad extension piston 222 separates the piston cylinder reservoir into an inner (or draw) reservoir 322 and an outer (or extension) reservoir 324. The separate extension reservoir 324 allows for independent operation of the extension piston 222 relative to the draw piston 236. The hydraulic reservoirs are preferably balanced to hydrostatic pressure of the annulus for consistent operation.

Referring to FIGS. 2 and 3, each piston assembly provides dedicated control lines 312–318. The draw piston 236 is controlled in the "draw" direction by fluid 326 entering the draw line 314 while fluid 326 exits through the "flush" line 312. When fluid flow is reversed in these lines, the draw piston 236 travels in the opposite or outward direction. Independent of the draw piston 236, the pad extension piston 222 is forced outward by fluid 328 entering the pad deploy line 316 while fluid 328 exits the pad retract line 318. Like the draw piston 236, the travel of the pad extension piston 222 is reversed when the fluid 328 in the lines 316 and 318 reverses direction. As shown in FIG. 2, the line selection, and thus the direction of travel, is controlled through the valves 240 by the downhole controller 214. The pump 238 provides the fluid pressure in the line selected.

Figure 4:
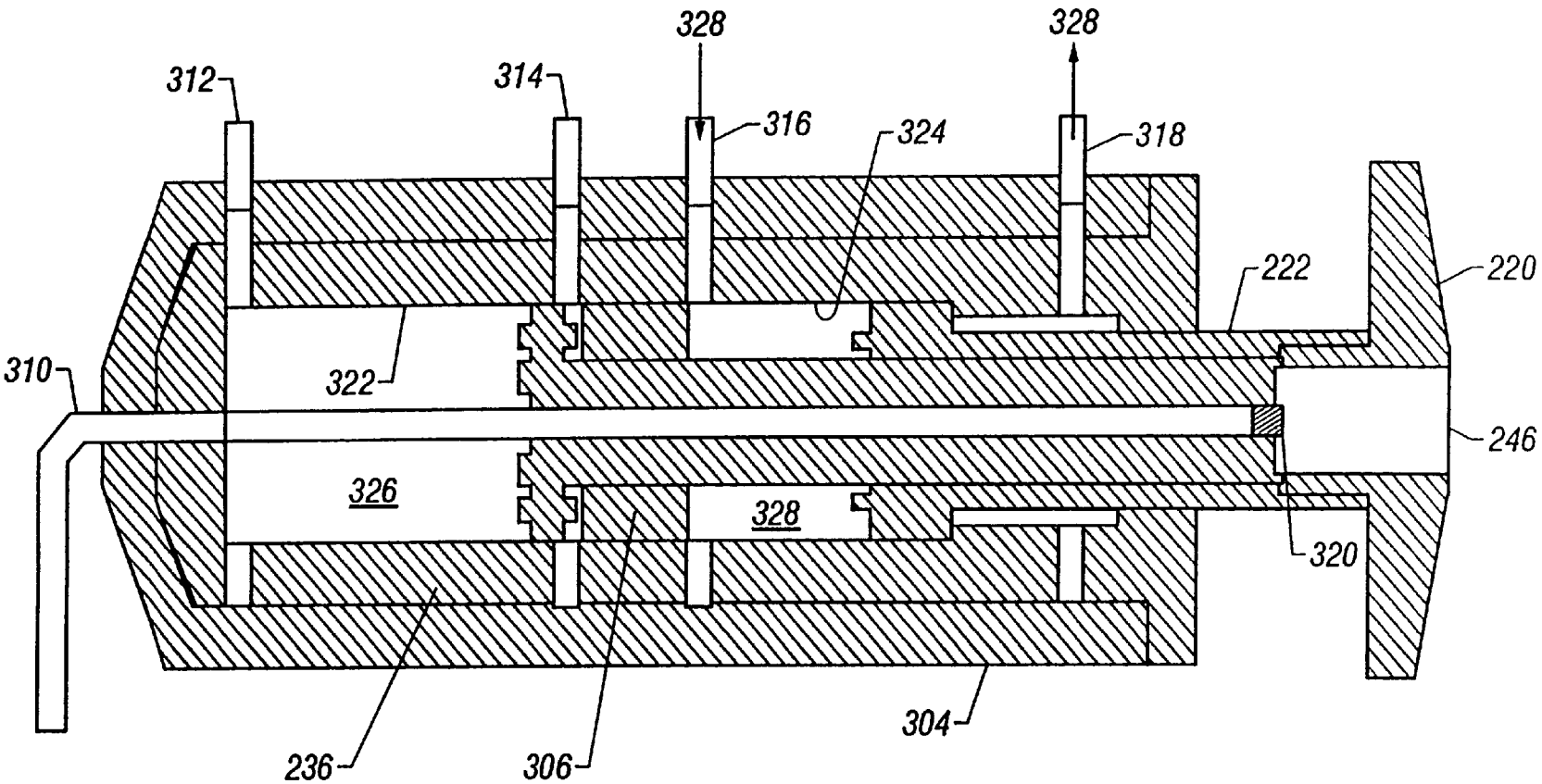
FIG. 4 is a cross sectional view of an integrated pump and pad showing an extended pad member according to the present invention.

Referring now to FIGS. 2 and 4, a pad piston 222 is shown at its outermost position. In this position, the pad 220 is in sealing engagement with the borehole wall 244. To get to this position, the piston 222 is forced radially outward and perpendicular to a longitudinal axis of the drill string 106 by fluid 328 entering the outer reservoir 324 through the pad deploy fluid line 316. The port 246 located at the end of the pad 220 is open, and formation fluid 216 will enter the port 246 when the draw piston 236 is activated.

Test volume can be reduced to substantially zero in an alternate embodiment according to the present invention. Still referring to FIG. 4, if the sensor 320 is slightly reconfigured to translate with the draw piston 236, and the draw piston extends to the borehole wall 244 with the pad piston 222 there would be zero volume at the port 246. One way to extend the draw piston 236 to the borehole wall 244 is to extend the housing assembly 304 until the pad 220 contacts the wall 244. If the housing 304 is extended, then there is no need to extend the pad piston 222. At the beginning of a test with the housing 304 extended, the pad 220, port 246, sensor 320, and draw piston 236 are all urged against the wall 244. Pressure should be vented to the upper annulus 226 via the vent valve 240 and vent 218 when extending elements into the annulus to prevent over pressurizing its intermediate annulus 228.

Another embodiment enabling the draw piston to extend is to remove the barrier 306 and use the flush line 312 to extend both pistons. The pad extension line 316 would then not be necessary, and the draw line 314 would be moved closer to the pad retract line 318. The actual placement of the draw line 314 would be such that the space between the base of the draw piston 236 and the base of the pad extension piston 222 aligns with the draw line 314, when both pistons are fully extended.

Figure 5:
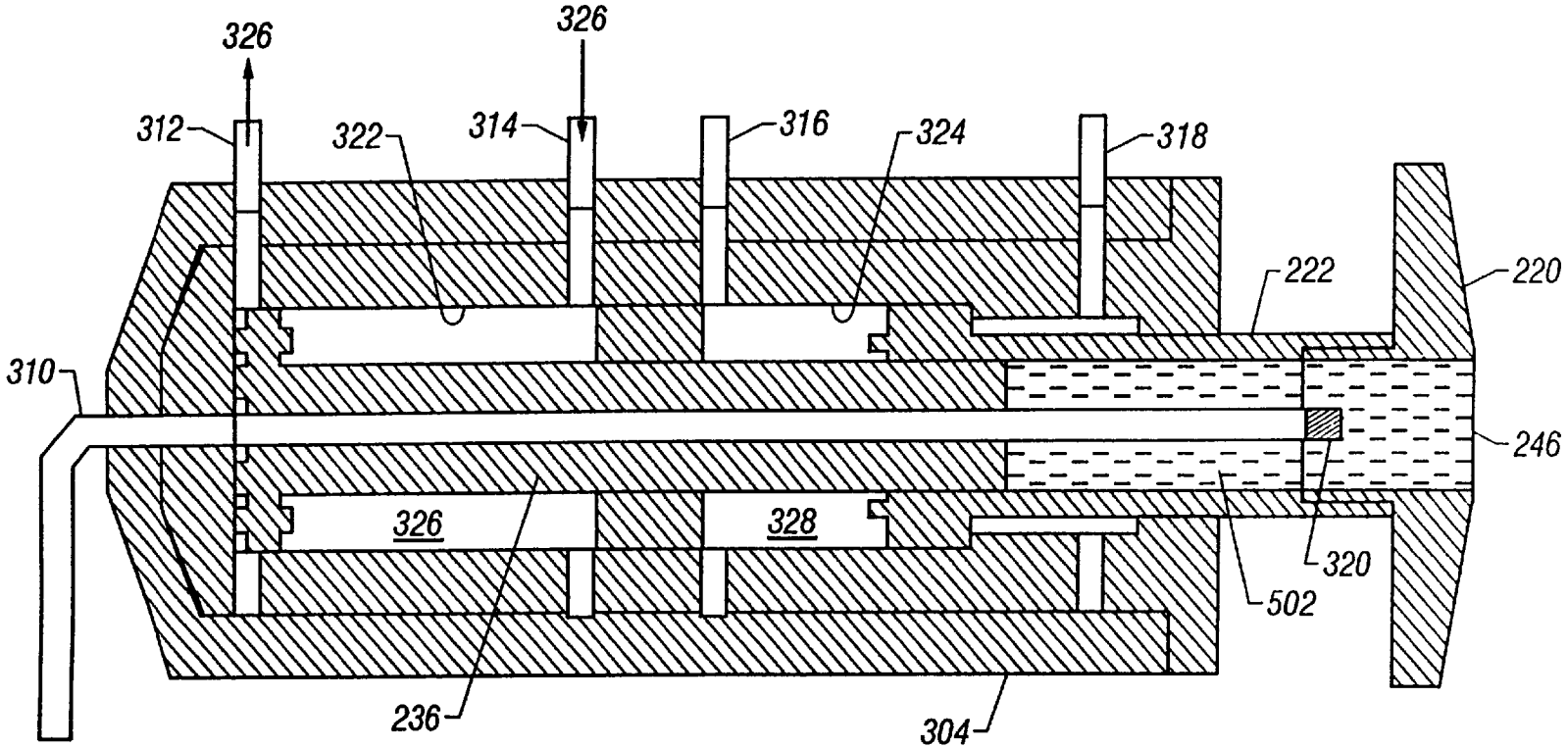
FIG. 5 is a cross sectional view of an integrated pump and pad after a pressure test according to the present invention.

Referring now to FIGS. 2 and 5, cross-sectional views are shown of an integrated pump and pad according the present invention after sampling. Formation fluid 216 is drawn into a sampling reservoir 502 when the draw piston 236 moves inward toward the base of the housing 304. As described earlier, movement of the draw piston 236 toward the base of the housing 304 is accomplished by hydraulic fluid or mud 326 entering the draw reservoir 322 through the draw line 314 and exiting through the flush line 312. Clean fluid, meaning formation fluid 216 substantially free of contamination by drilling mud, can be obtained with several draw-flush-draw cycles. Flushing will be described in detail later.

Fluid drawn into the system may be tested downhole with one or more sensors 320, or the fluid may be pumped to optional storage tanks 242 for retrieval and surface analysis or both. The sensor 320 may be located at the port 246, with its output being transmitted or connected to the controller 214 via a sensor tube 310 as a feedback circuit. The controller may be programmed to control the draw of fluid from the formation based on the sensor output. The sensor 320 may also be located at any other desired suitable location in the system. If not located at the port 246, the sensor 320 is preferably in fluid communication with the port 246 via the sensor tube 310.

Figure 6:
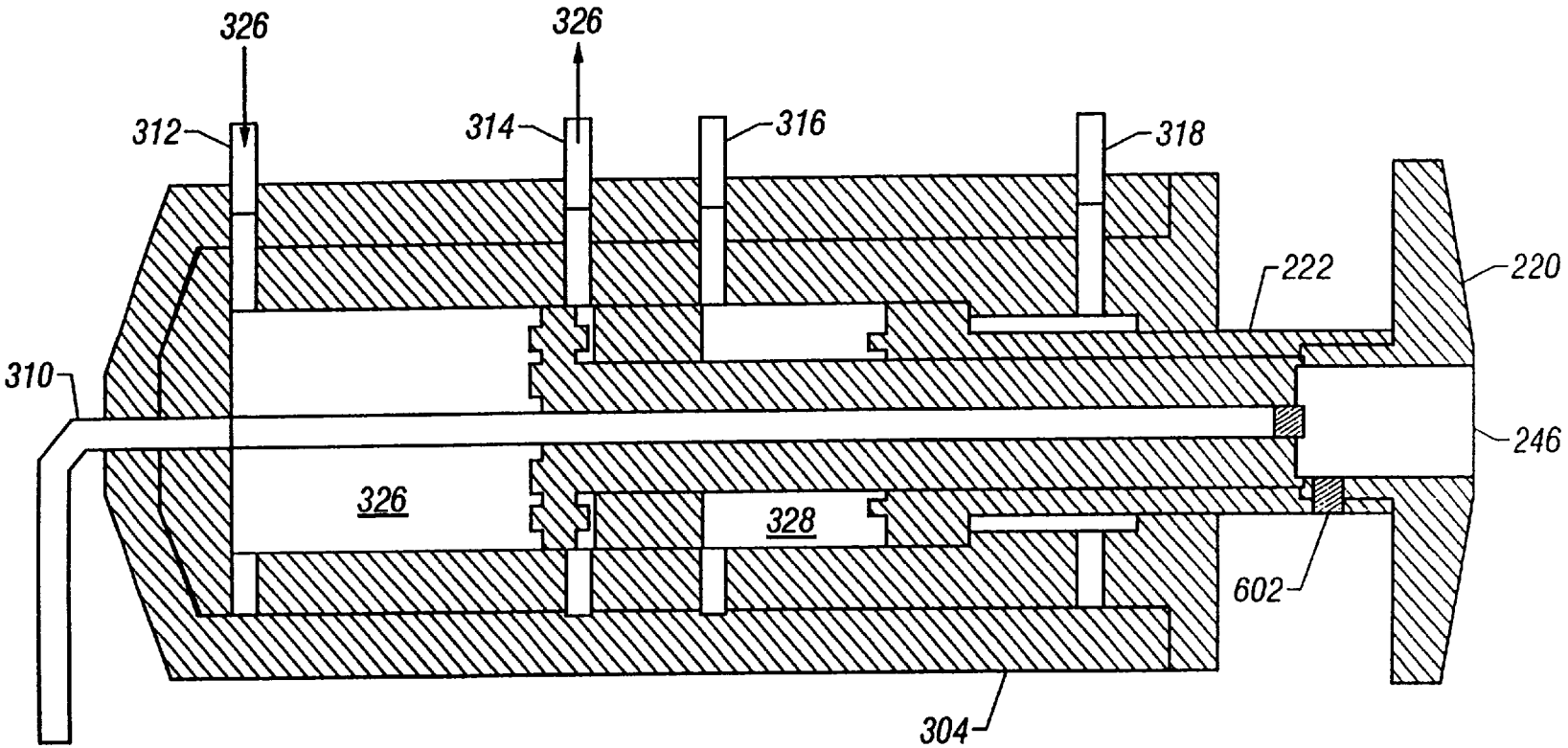
FIG. 6 is a cross sectional view of an integrated pump and pad after flushing the system according to the present invention.

Referring to FIGS. 2 and 6, a detailed cross sectional view of an integrated pump and pad according the present invention is shown after flushing the system. The system draw piston 236 flushes the system when it is returned to its pre-draw position or when both pistons 222 and 236 are returned to the initial positions. The translation of the fluid piston 236 to flush the system occurs when fluid 326 is pumped into the draw reservoir through the flush line 312. Formation fluid 216 contained in the sample reservoir 502 is forced out of the reservoir as shown in FIG. 5. A check valve 602 may be used to allow fluid to exit into the annulus 228, or the fluid may be forced out through the port 246 as shown in FIG. 6. The check valve 602 should not be used when the upper packer is extended. Retracting its packer 232 will ensure the intermediate annulus 228 is not over pressurized when fluid is flushed via the check valve 602. The check valve 602 may also be relocated such that expelled fluid is vented to the upper annulus 226.

Figure 7:
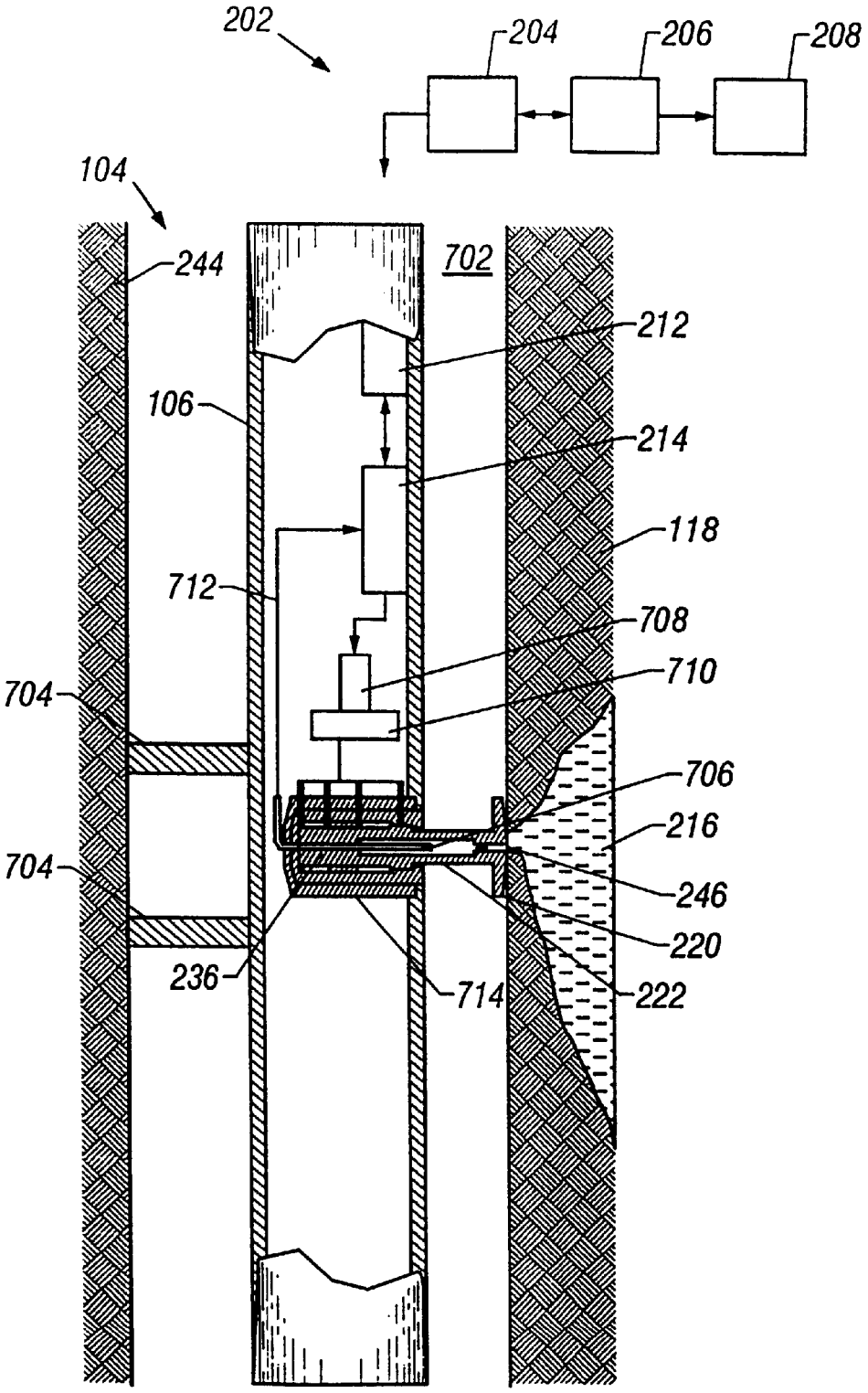
FIG. 7 shows an alternate embodiment of the present invention wherein packers are not required.

FIG. 7 shows an alternative embodiment of the present invention wherein packers are not required and the optional storage reservoirs are not used. A drill string 106 carries downhole components comprising a communication/power unit 212, controller 214, pump 708, a valve assembly 710, stabilizers 704, and a pump assembly 714. A surface controller sends commands to and receives data from the downhole components. The surface controller comprises a two-way communications unit 204, a processor 206, and an input-out device 208.

In this embodiment, stabilizers or grippers 704 selectively extend to engage the borehole wall 244 to stabilize or anchor the drill string 106 when the piston assembly 714 is adjacent a formation 118 to be tested. A pad extension piston 222 extends in a direction generally opposite the grippers 704. The pad 220 is disposed on the end of the pad extension piston 222 and seals a portion of the annulus 702 at the port 246. Formation fluid 216 is then drawn into the piston assembly 714 as described above in the discussion of FIGS. 4 and 5. Flushing the system is accomplished as described above in the discussion of FIG. 6.

The configuration of FIG. 7 shows a sensor 706 disposed in the fluid sample reservoir of the piston assembly 714. The sensor senses a desired parameter of interest of the formation fluid such as pressure, and the sensor transmits data indicative of the parameter of interest back to the controller 214 via conductors, fiber optics or other suitable transmission conductor. The controller 214 further comprises a controller processor (not separately shown) that processes the data and transmits the results to the surface via the communications and power unit 212. The surface controller receives, processes and outputs the results described above in the discussion of FIGS. 1 and 2.

Modifications to the embodiments described above are considered within scope of this invention. Referring to FIG. 2 for example, the draw piston 236 and pad piston 222 may operated electrically, rather than hydraulically as shown. An electrical motor can be used to reciprocate each piston independently, or preferably, one motor controls both pistons. The electrical motor could replace the pump 238 shown in FIG. 2. If a controllable pump power source such as a spindle or stepper motor is selected, then the piston position can be selectable throughout the line of travel. This feature is preferable in applications where precise control of system volume is desired.

A spindle motor is a known electrical motor wherein electrical power is translated into rotary mechanical power. Controlling electrical current flowing through motor windings controls the torque and/or speed of a rotating output shaft. A stepper motor is a known electrical motor that translates electrical pulses into precise discrete mechanical movement. The output shaft movement of a stepper motor can be either rotational or linear.

Using either a stepper motor or a spindle motor, the selected motor output shaft is connected to a device for reciprocating the pad and draw pistons 222 and 236. A preferred device is a known ball screw assembly (BSA). A BSA uses circulating ball bearings (typically stainless steel or carbon) to roll along complementary helical groves of a nut and screw subassembly. The motor output shaft may turn either the nut or screw while the other translates linearly along the longitudinal axis of the screw subassembly. The translating component is connected to a piston, thus the piston is translated along the longitudinal axis of the screw subassembly axis.

Now that system embodiments of the invention have been described, a preferred method of testing a formation using the preferred system embodiment will be described. Referring first to FIGS. 1–6, a tool according to the present invention is conveyed into a borehole 104 on a drill string 106. The drill string is anchored to the well wall using a plurality of grippers 210 that are extended using methods well known in the art. The annulus between the drill string 106 and borehole wall 244 is separated into an upper section 226, an intermediate section 228 and a lower section 230 using expandable packers 232 and 234 known in the art. Using a pad extension piston 222, a pad member 220 is brought into sealing contact with the borehole wall 244 preferably in the intermediate annulus section 228. Using a pump 238, drilling fluid pressure in the intermediate annulus 228 is reduced by pumping fluid from the section through a vent 218. A draw piston 236 is used to draw formation fluid 216 into a fluid sample volume 502 through a port 246 located on the pad 220. At least one parameter of interest such as formation pressure, temperature, fluid dielectric constant or resistivity is sensed with a sensor 320, and the sensor output is processed by a downhole processor. The results are then transmitted to the surface using a two-way communications unit 212 disposed downhole on the drill string 106. Using a surface communications unit 204, the results received and forwarded to a surface processor 206. The method further comprises processing the data at the surface for output to a display unit, printer, or storage device 208.

A test using substantially zero volume can be accomplished using an alternative method according to the present invention. To ensure initial volume is substantially zero, the draw piston 236 and sensor are extended along with the pad 220 and pad piston 222 to seal off a portion of the borehole wall 244. The remainder of this alternative method is essentially the same as the embodiment described above. The major difference is that the draw piston 236 need only be translated a small distance back into the tool to draw formation fluid into the port 246 thereby contacting the sensor 320. The very small volume reduces the time required for the volume parameters being sensed to equalize with the formation parameters.

Figure 8:
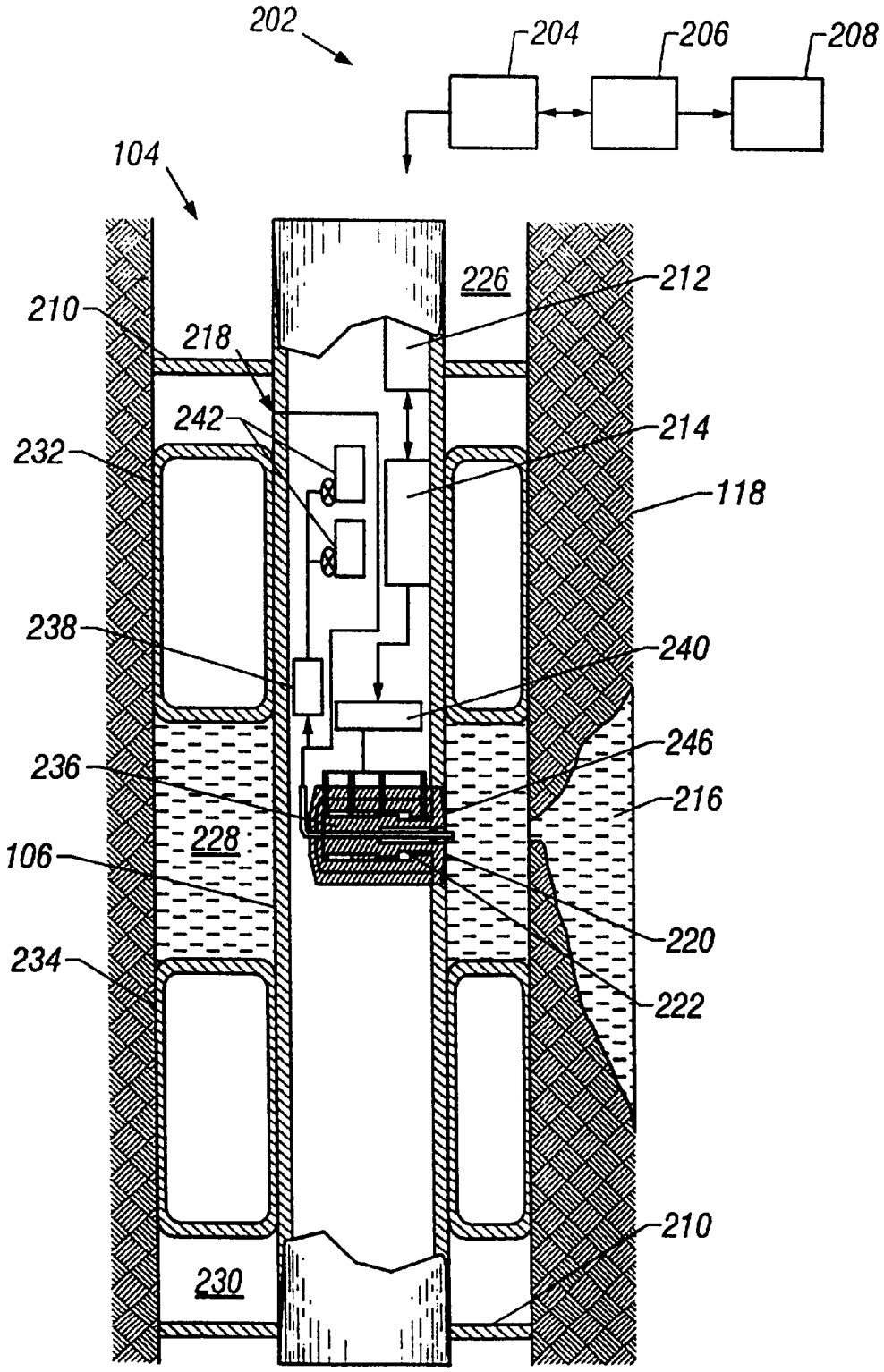
FIG. 8 shows and alternate mode of operation of a preferred embodiment wherein samples are taken with the pad member in a retracted position.

FIG. 8 illustrates another method of operation wherein samples of formation fluid 216 are taken with the pad member 220 in a retracted position. The annulus is separated into the several sealed sections 226, 228 and 230 as described above using expandable packers 232 and 234. Using a pump 238, drilling fluid pressure in the intermediate annulus 228 is reduced by pumping fluid from the section through a vent 218. With the pressure in the intermediate annulus 228 lower than the formation pressure, formation fluid 216 fills the intermediate annulus 228. If the pumping process continues, the fluid in the intermediate annulus becomes substantially free of contamination by drilling mud. Then without extending the pad member 220, the draw piston 236 is used to draw formation fluid 216 into a fluid sample volume 502 through a port 246 exposed to the fluid 216. At least one parameter of interest such as those described above is sensed with a sensor 320, and the sensor output is processed by a downhole processor. The processed data is then transmitted to the surface controller 202 for further processing and output as described above.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A tool for obtaining in situ a parameter of interest of a subterranean formation, the tool comprising:

(a)a carrier member for conveying the tool into a borehole, the tool having a port associated with a sealing member for providing communication with fluid in the formation, the tool further including an internal test volume at the port for receiving formation fluid;

(b) a device integrally disposed with the internal test volume, the device operating to draw formation fluid into the volume; and (c) a sensor operatively associated with the internal test volume for detecting a parameter of interest of the fluid, the fluid parameter of interest being indicative of the formation parameter of interest.

2. The tool of claim 1, wherein the sealing member comprises a pad seal on an extendable piston for sealing a portion of the borehole around the port.

3. The tool of claim 1, wherein the sealing member comprises a pair of packers for sealing an annular portion of the borehole around the port.

4. The tool of claim 1, wherein the device for drawing fluid into the internal test volume includes a pump.

5. The tool of claim 1, wherein the device for drawing fluid into the internal test volume includes a piston for controlling volume in the internal test volume.

6. The tool of claim 5, wherein the draw piston is movably disposed within an extendable piston.

7. The tool of claim 1, wherein the carrier member is selected from a group consisting of (i) a jointed pipe drill string; (ii) a coiled tube; and (iii) wireline.

8. The tool of claim 1, wherein the device for drawing fluid into the internal test volume is hydraulically operated using a fluid selected from a group consisting of (i) an oil and (ii) drilling mud.

9. The tool of claim 1, wherein the device for drawing fluid into the internal test volume is operated by an electric motor.

10. The tool of claim 9, wherein the electric motor is selected from a group consisting of (i) a spindle motor and (ii) a stepper motor.

11. The tool of claim 1 further comprising a conduit for providing fluid communication between the internal test volume and the sensor.

12. The tool of claim 1 further comprising a pump for transferring the fluid from the port to at least one fluid storage reservoir.

13.The apparatus of claim 1 further comprising an extendable housing and wherein the device for drawing fluid into the internal test volume is disposed in the extendable housing.

14. A method for obtaining a parameter of interest of a subterranean formation in-situ, the method comprising:

(a) sealing a portion of a borehole wall;

(b) exposing a port in a tool to the sealed portion;

(c) drawing fluid into a tool internal test volume at the port using a device integrally disposed with the internal test volume; and (d) detecting a parameter of interest of the fluid in the internal test volume with a sensor, the fluid parameter of interest being indicative of the a formation parameter of interest.

15. The method of claim 14, wherein the tool is conveyed into the borehole on a carrier member selected from a group consisting of (i) a drill pipe; (ii) a coiled tubing; and (iii) a wireline.

16. The method of claim 14, wherein sealing a portion of the borehole wall includes extending a selectively extendable pad member into sealing contact with the borehole wall.

17. The method of claim 14 further comprising operating the fluid drawing device hydraulically using hydraulic fluid selected from a group consisting of (i) an oil and (ii) drilling mud.

18. The method of claim 14, wherein the fluid drawing device includes a reciprocating piston, the method further comprising moving the reciprocating piston between a first position and a second position, the reciprocating piston drawing the fluid into the port when moving from the first position to the second position.

19. The method of claim 14 further comprising providing fluid communication between the port and the sensor through a conduit.

20. The method of claim 14 further comprising transferring the fluid from the port to a fluid storage reservoir using a pump.

21. The method of claim 14 further comprising operating the fluid drawing device with an electric motor.

22. The method of claim 21, wherein the electric motor is selected from a group consisting of (i) a spindle motor and (ii) a stepper motor.

23. The method of claim 14 further comprising extending a housing from the tool, the fluid drawing device being disposed in the housing.

* * * * *